US012332018B2

(12) United States Patent
Benes

(10) Patent No.: US 12,332,018 B2
(45) Date of Patent: Jun. 17, 2025

(54) PISTOL HOLSTER

(71) Applicant: Miroslav Benes, Hradec Kralove (CZ)

(72) Inventor: Miroslav Benes, Hradec Kralove (CZ)

( * ) Notice: Subject to any disclaimer, the term of this patent is extended or adjusted under 35 U.S.C. 154(b) by 0 days.

(21) Appl. No.: 18/280,454

(22) PCT Filed: Sep. 23, 2022

(86) PCT No.: PCT/CZ2022/000038
§ 371 (c)(1),
(2) Date: Sep. 5, 2023

(87) PCT Pub. No.: WO2023/051853
PCT Pub. Date: Apr. 6, 2023

(65) Prior Publication Data

US 2024/0302131 A1 Sep. 12, 2024

(30) Foreign Application Priority Data

Sep. 30, 2021 (CZ) ..... CZ2021-462

(51) Int. Cl.
*F41C 33/02* (2006.01)

(52) U.S. Cl.
CPC ..... *F41C 33/0227* (2013.01); *F41C 33/0254* (2013.01); *F41C 33/0263* (2013.01)

(58) Field of Classification Search
CPC ..... F41C 33/0227; F41C 33/0254; F41C 33/0263; F41C 33/02
See application file for complete search history.

(56) References Cited

U.S. PATENT DOCUMENTS 2,088,811 A * 8/1937 Ray ..... F41C 33/0263 224/666
2,708,537 A * 5/1955 Dec ..... F41C 33/0272 446/28
3,942,692 A * 3/1976 Chica ..... F41C 33/0227 224/665
4,463,884 A * 8/1984 Parlante ..... F41C 33/0227 224/193
5,509,591 A 4/1996 Carver
(Continued)

FOREIGN PATENT DOCUMENTS

AU 676978 B1 3/1997
CA 2171381 C 9/1997
(Continued)

OTHER PUBLICATIONS

International Search Report for related PCT International App. No. PCT/CZ2022/000038.

*Primary Examiner* — Derek J Battisti
(74) *Attorney, Agent, or Firm* — Bryant J. Keller; Kirton McConkie

(57) ABSTRACT

A pistol holster which is formed by a rigid hollow body which fully covers the entire firearm except for the grip and thus protects it from damage, containing a longitudinal inner cavity situated inside and, under the back of the holster in which cavity there is movably and flexibly seated firearm sight guide, engaged in the holes in the body of which guide are spring elements mounted and locked therein, which also fit against the flat locking plate in the cavity of the holster with the holster also containing a sight cover to secure the position of the sight guide with the locking plate and spring elements in the cavity.

11 Claims, 10 Drawing Sheets

(56) References Cited

U.S. PATENT DOCUMENTS

| | | | | |
|---|---|---|---|---|
| 11,408,709 | B2 * | 8/2022 | DeSantis | F41C 33/0209 |
| 11,566,866 | B1 * | 1/2023 | Baker | F41C 33/0209 |
| 2007/0181619 | A1 * | 8/2007 | Seyfert | F41C 33/04 224/912 |
| 2008/0179359 | A1 * | 7/2008 | Aberle | F41C 33/0245 224/243 |
| 2010/0299905 | A1 * | 12/2010 | McCoy | F41C 33/0236 29/428 |
| 2013/0306691 | A1 * | 11/2013 | Baumann | F41C 33/0263 224/244 |
| 2018/0164072 | A1 * | 6/2018 | McKendrick | F41C 33/0263 |
| 2020/0141693 | A1 | 5/2020 | Rassias | |
| 2020/0232755 | A1 | 7/2020 | Houck et al. | |
| 2022/0282952 | A1 * | 9/2022 | Baumann | F41C 33/0263 |

FOREIGN PATENT DOCUMENTS

| | | | |
|---|---|---|---|
| CZ | 17500 | U1 | 4/2007 |
| CZ | 19391 | U1 | 3/2009 |
| CZ | 35767 | U1 | 2/2022 |

* cited by examiner

PISTOL HOLSTER

FIELD OF THE INVENTION

The solution concerns modular pistol holster formed by a shaped, solid plastic part of the holster, which fully covers the entire pistol (except for the pistol grip) and protects it from damage.

BACKGROUND OF THE INVENTION

Pistol holsters are described by a number of patents, which include EP 1975542. U.S. Pat. Nos. 3,630,820, 4,694,980, 5,018,654, 468,556, 1,113,530, 1,851,352, 1,951,865, 4,101,060, 4,277,007, 5,810,221, 6,732,891, 6,769,582, 6,799,392 and others.

There are also known solutions according to files US 20200141693A1 and U.S. Pat. No. 5,768,816, wherein the firearm is secured in the holster by a projection that extends into the ejection port in the slide and is unlocked by rotational movement of the firearm, which is not quite optimal. File US 20200232755A1 addresses the design of a holster with a hinged loop with the possibility of placing a spacer insert in the holster body cavity for use of a firearm with a tactical light, which, however, does not provide the possibility to accommodate the firearm with a silencer using the same holster parts. File U.S. Pat. No. 3,669,325 describes the method of retaining the firearm with a hinged loop in the in the trigger guard area, which, as testing results show, is not optimal when dealing with emergencies. Also known is the technical solution according to file CZ19391U1 that describes a universal right/left method of attaching accessories to the body of the holster, wherein the original system of trigger guard safeties is replaced with a hinged safety over the slide cover plate and a system of a sliding sight guide is added to enable the use of the firearm with a silencer. File CZ 26965 U1 describes the assembly of the control mechanism of the hinged loop that retains the firearm, addressing the structural arrangement of the hinged loop and of guide of the control element of the safety mechanism.

The objective of the presented invention is a modular arrangement of the holster, consisting in the structural design of the shape, mount and movement of the sight guiding part, wherein the part is held in the ready position by spring elements, enabling handling, safe holstering and retention of the pistol in the holster with or without an attached silencer, or with or without a tactical light, and without the need to alter, or add additional parts to, the holster assembly.

SUMMARY OF THE INVENTION

The invention applies to a pistol holster that consists of a solid hollow-shaped body which fully covers the entire firearm except for the grip, thus protecting the firearm from damage.

The basis of the invention lies in the fact that the holster, which retains the pistol with an attached tactical light and silencer, or with an attached tactical light without a silencer, or with an attached silencer and without a tactical light, or just the pistol without accessories, includes, in its inner cavity below the back of the holster, a longitudinal shaped space for the movable and flexible placement sight guide inside the shaped inner cavity of the holster, where, in order to ensure the movement of the sight guide in the shaped inner cavity of the holster, the holster contains a flat locking place and a shaped plug that retains the locking plate, the spring elements and the sight guide in the shaped cavity of the holster.

The sight guide protrudes on both of its longer sides and is preferably chamfered on the shorter face sides to guide the firearm or the silencer more easily when holstering or unholstering and is equipped with a longitudinal centre channel to guide the sights of the firearm in the lower part of the holster.

The spring elements consist of springs, preferably coiled compression springs or profiled flat springs, mounted in holes on the upper side of the sight and slid onto the guiding lugs of the locking plate located in the holster cavity above the sights.

The body of the holster is provided with side lugs, preferably for the attachment of a belt-mounted holster carrier or other holster accessories.

The lower part of the holster is preferably fitted with an internal spacer to accommodate a tactical light.

The advantage of the holster arrangement lies in the structural design of the shape, the mount and the movement of the sight guide after the assembly is fit into shaped cavity of the plastic body of the holster, wherein this part is kept in the working position and enables handling, safe holstering and unholstering of a separate firearm, of the firearm with or without the silencer attached, or with or without a tactical light attached, without the need to alter, or add additional parts to, the holster assembly.

The solution may be applied to the basic types of duty holsters for both holsters for pistols, with or without a silencer, where the underlying principle of retaining the firearm in the holster is by the trigger guard of the firearm and for tactical holsters which contain shaped cavities for holstering the firearm with the tactical light attached and in which the firearm is retained by the upper edge of the slide and frame of the firearm or by another suitable retention element.

DESCRIPTION OF DRAWINGS

Several examples of the holster according to the present invention are shown in the enclosed drawings, where.

EXAMPLES OF INVENTION EMBODIMENTS

Figure 1:
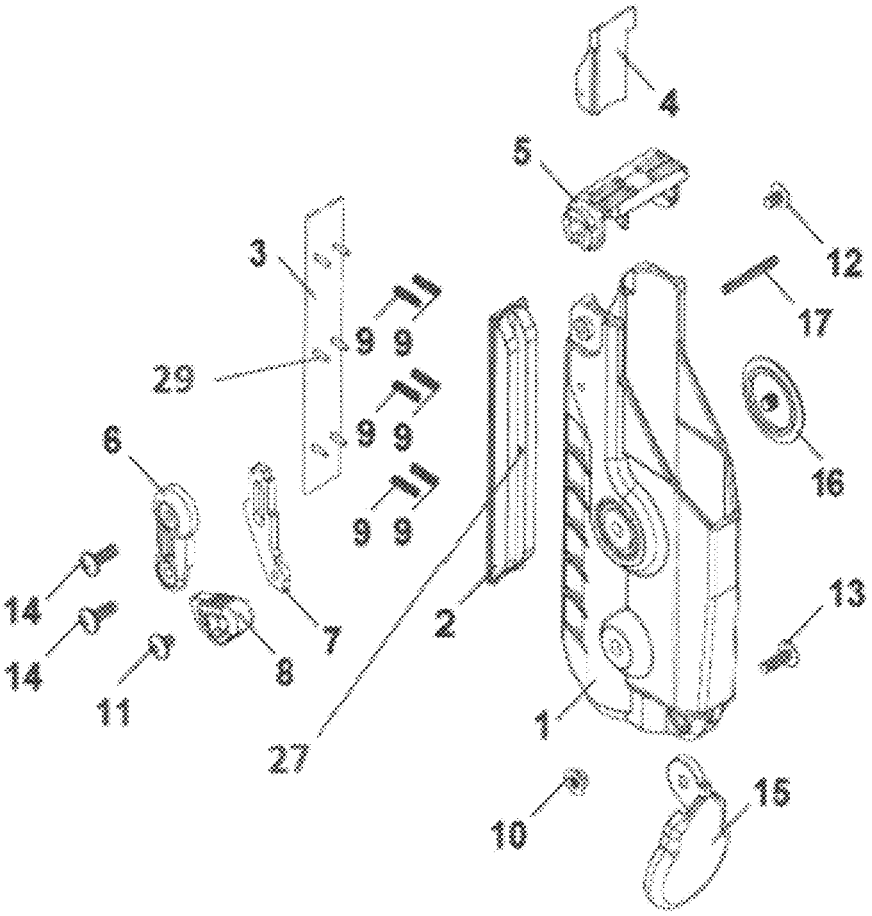
FIG. 1 shows a three-dimensional expanded view of the holster with the individual parts separated.
Figure 2:
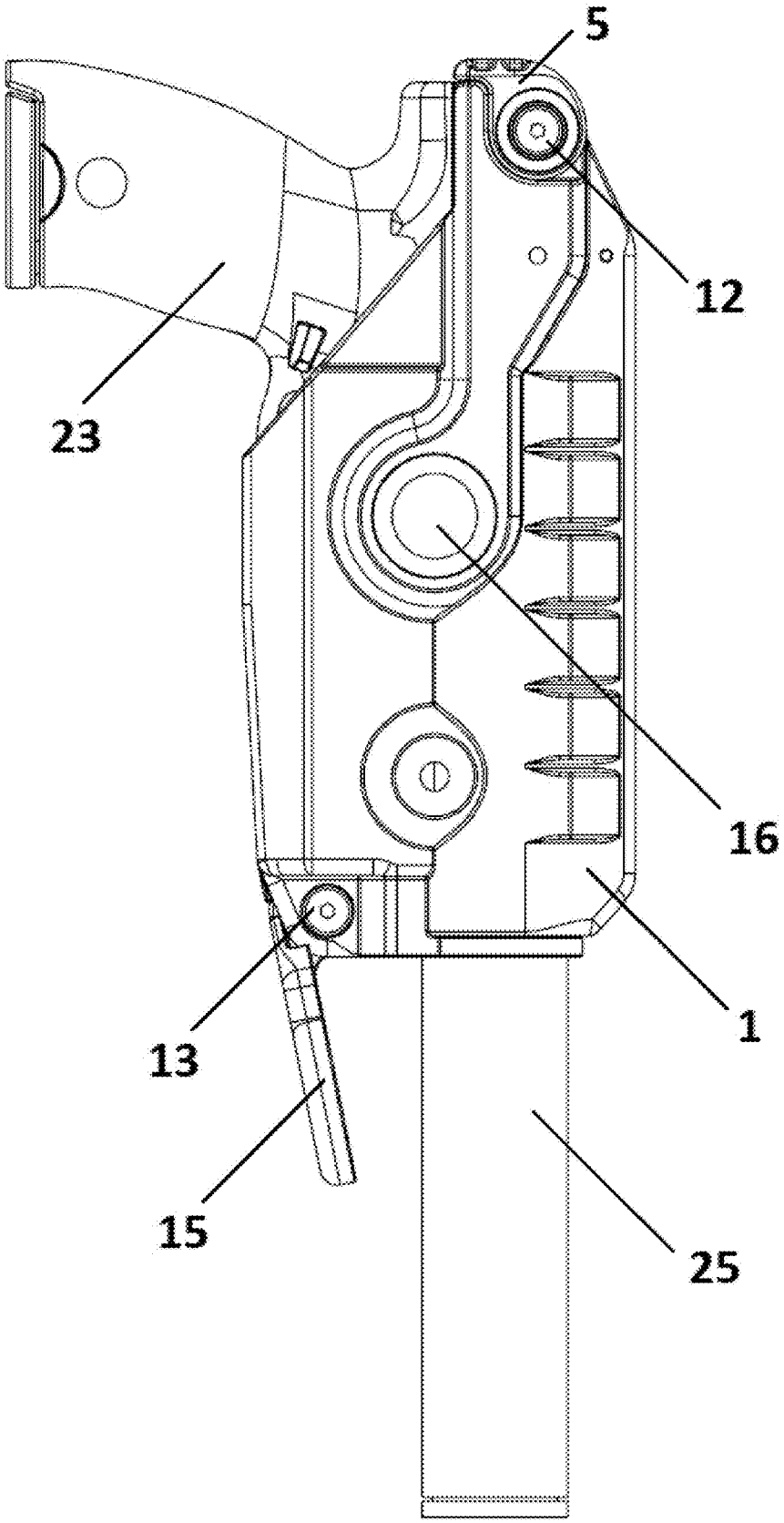
FIG. 2 shows a view of a holstered firearm with a tactical light and silencer attached.
Figure 3:
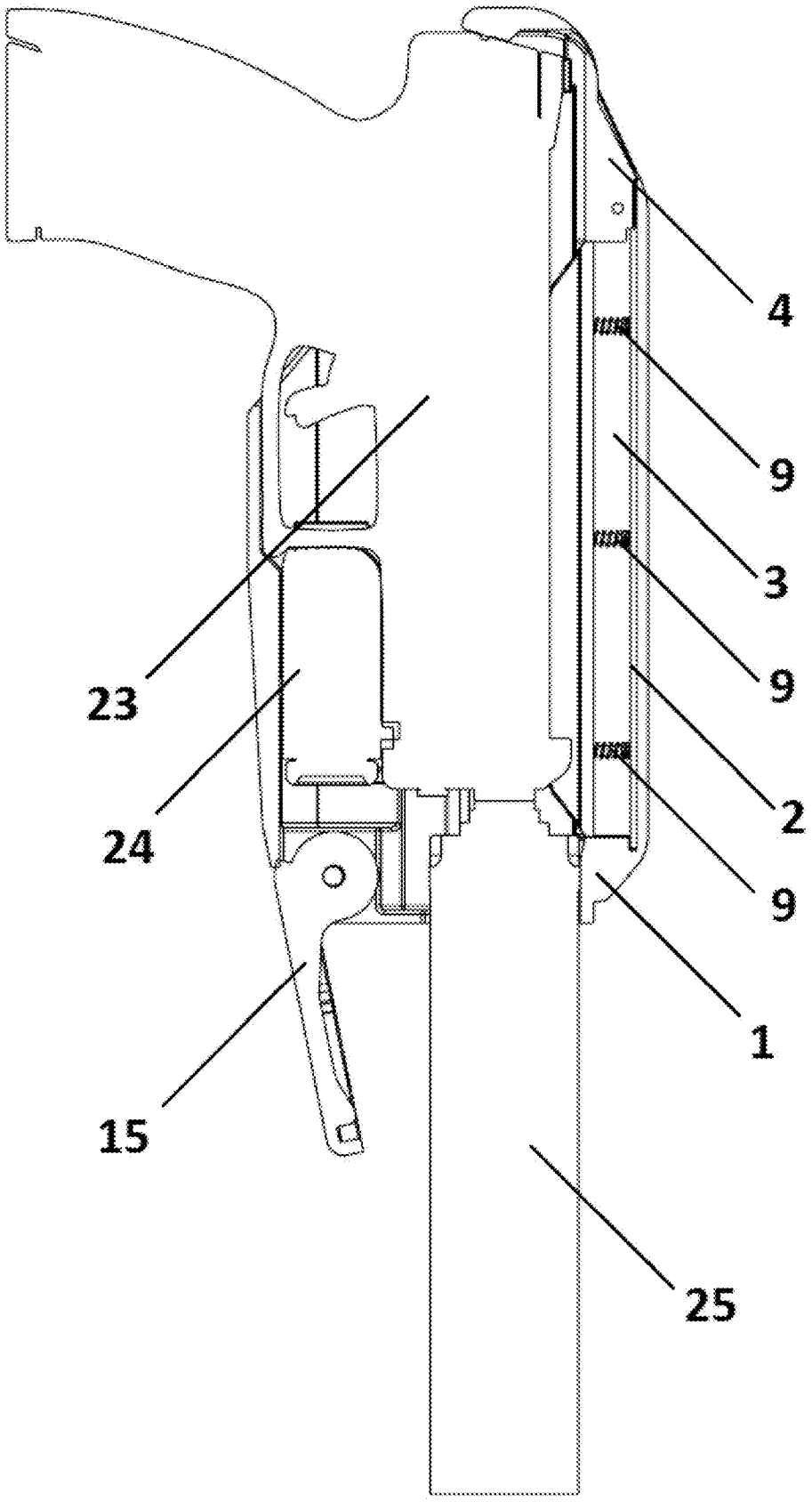
FIG. 3 shows a sectional view of a holstered firearm with a tactical light and a silencer attached.
Figure 4:
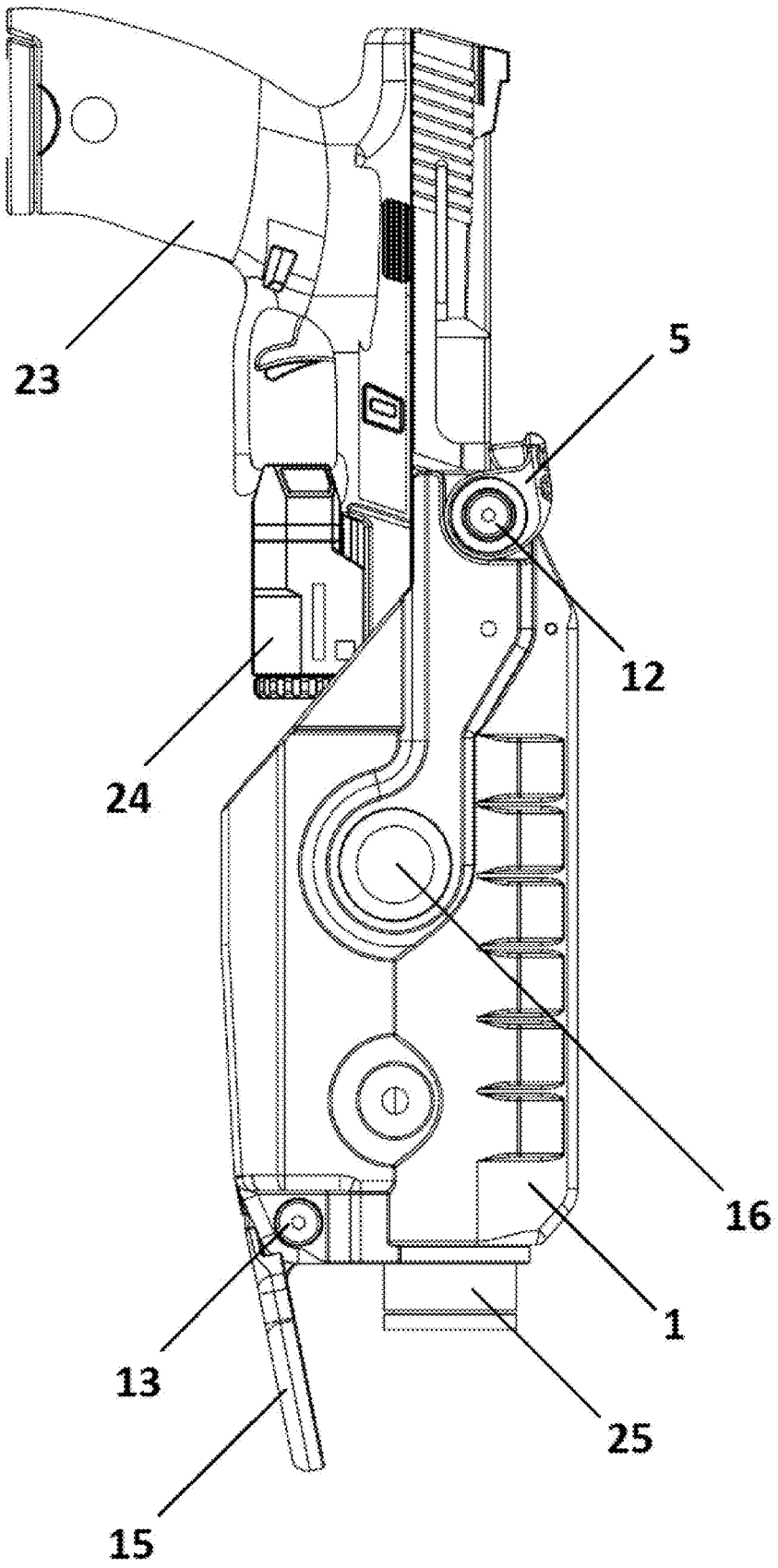
FIG. 4 shows the holstering of a firearm with a tactical light and a silencer attached.
Figure 5:
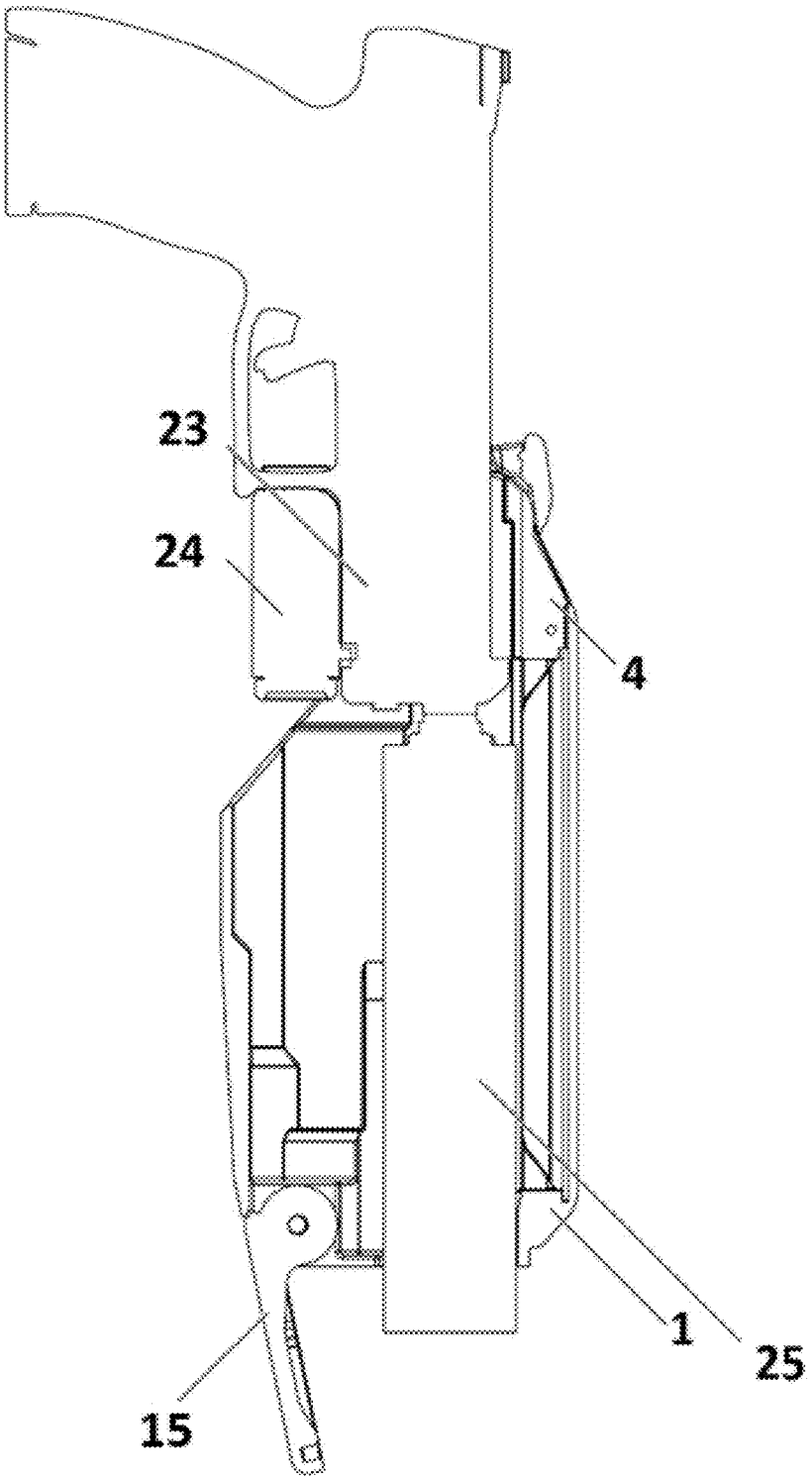
FIG. 5 shows the holstering of a firearm with a silencer attached.
Figure 6:
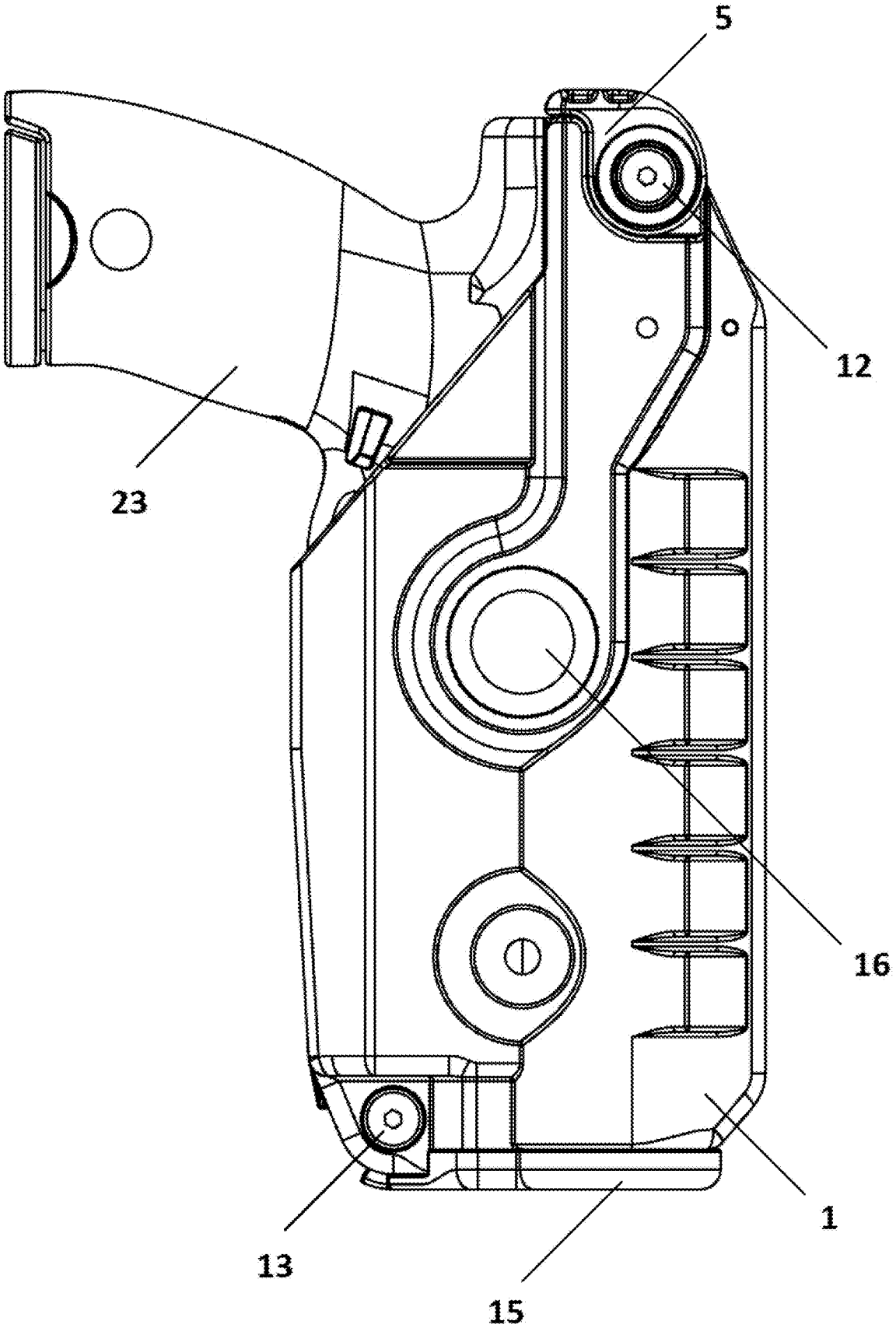
FIG. 6 shows a holstered firearm with a tactical light attached.
Figure 7:
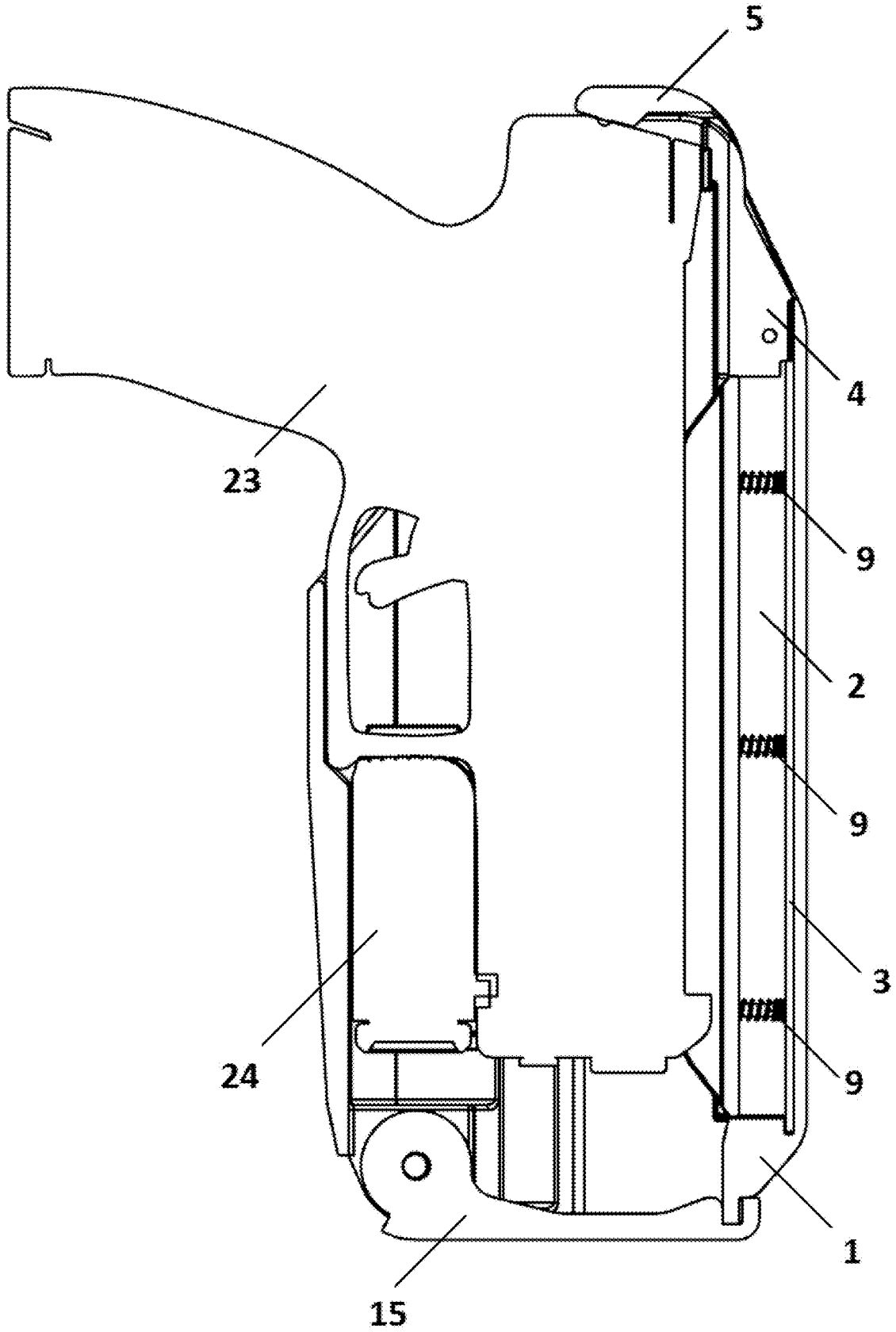
FIG. 7 is a sectional view of a separate holstered firearm.
Figure 8:
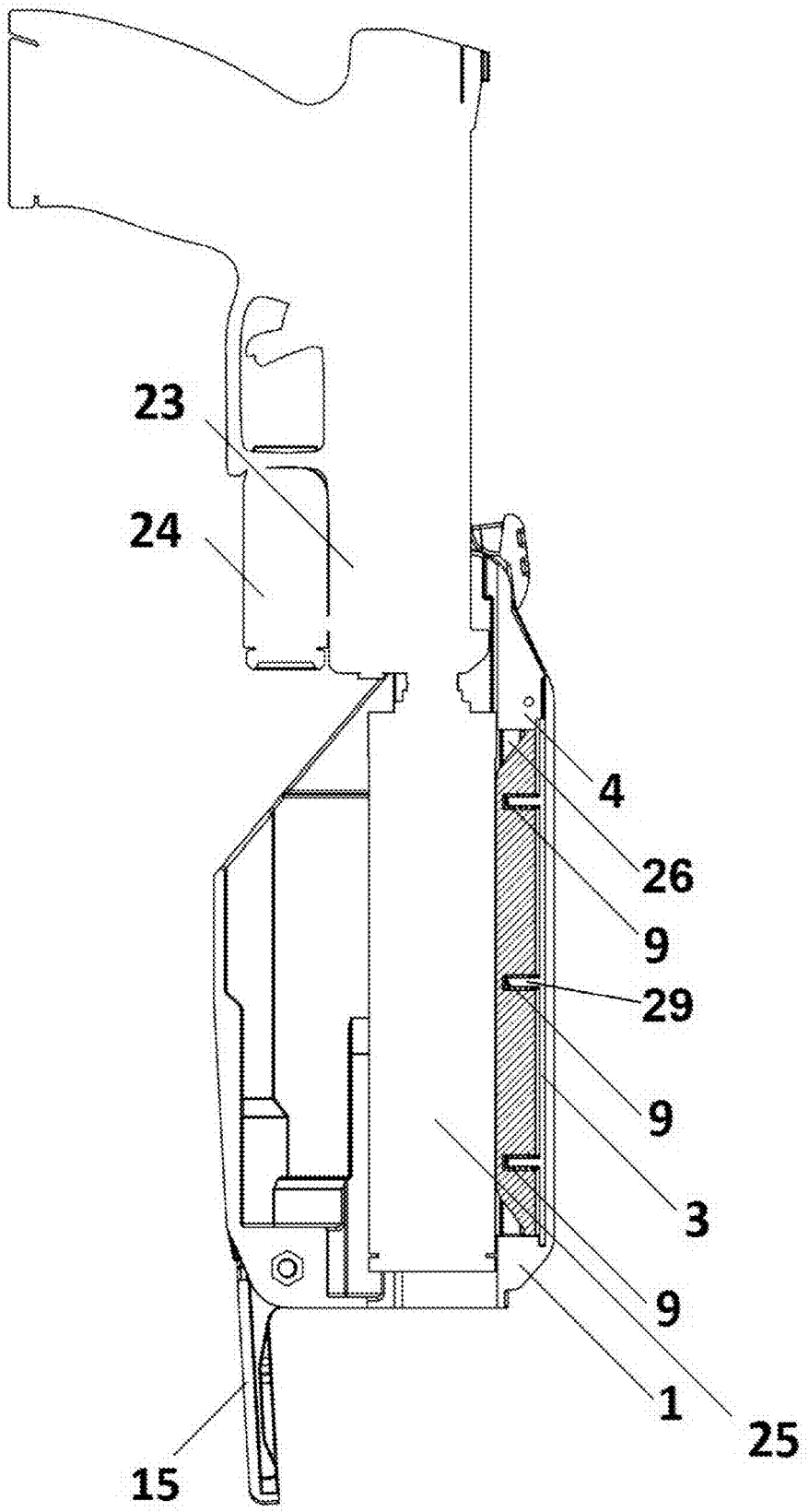
FIG. 8 shows a firearm with a silencer and a tactical light attached being holstered.
Figure 9:
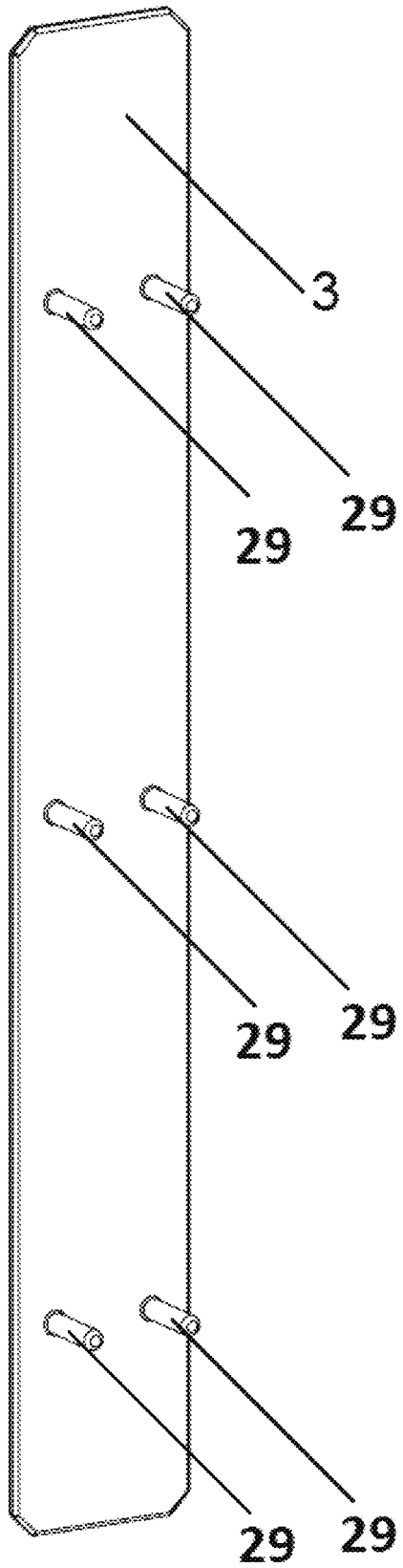
FIG. 9 is a view of the locking plate with protrusions for sliding on the spring elements.
Figure 10:
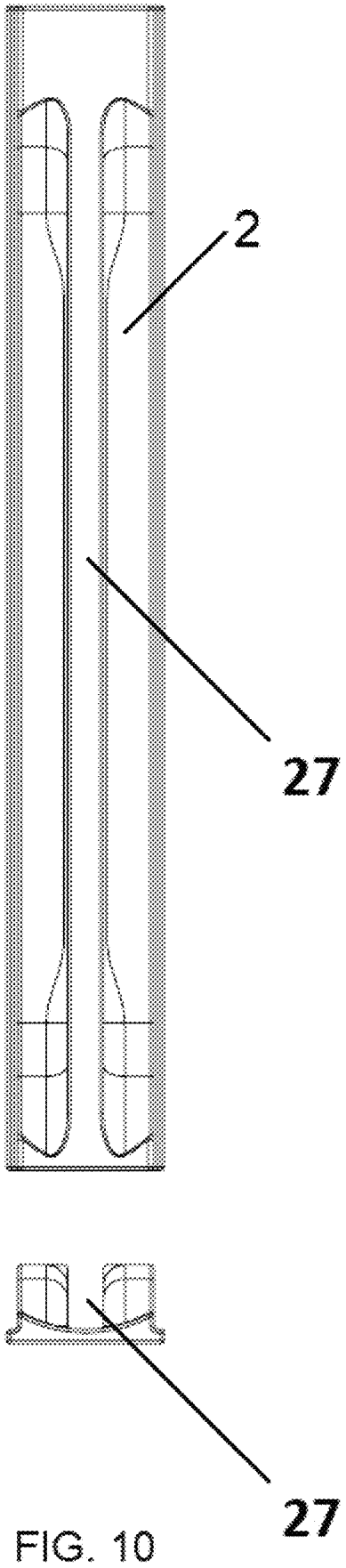
FIG. 10 shows the sight guide with a centre channel.

The holster assembly comprises a hollow shaped body 1, which covers the entire firearm (except for the grip) and protects it from damage. In the upper inner section of the holster there is a longitudinal hollow shape 26 for placing the sight guide 2, spring elements 9 and locking place 3 for the sights, containing side lugs located on the inside of both opposite sides of the shaped cavity 26 of the holster.

The underlying idea of the invention is the movable sight mount in the inner cavity 26 of the holster, located under the back of the holster, which enables a firearm in various modifications to be holstered in the same type of holster. The advantage of the proposed solution is that it retains the firearm in the required position without the need for user reconfiguration of the holster by adding additional parts.

FIG. 1 shows the three-dimensional exploded view of the holster and its individual parts, namely, sight guide 2, sight locking plate 3, sight cover 4, retention loop 5, retention loop 5 cap 6, retention loop 5 link Z, loop 5 control button 8, spring elements 9 for sighs, silencer 25 cover 15 nuts 10, button screw 11, loop 5 screw 12, silencer 25 cover 15 screw 13, loop 5 cover screw 14, silencer 25 cover 15, notch cover 16, sight cover 4 locking pin 17, link 7 spring 18, retention loop 5 spring 19, spacer column 20, another spacer column 21, notch cover 16 screw 22.

The solution enables the firearm frame 23 to be holstered and retained with the following options:

1/pistol with a tactical light 24 and a silencer 25 attached

2/pistol with a tactical light 24 attached and without a silencer 25

3/pistol with the silencer 25 attached and without a tactical light 24

4/pistol without accessories

The holster may be equipped with additional accessories that further increase the usability of the holster, for example, shaped spacing inserts according to the type of the tactical light 24, etc.

If the holster is empty, without a firearm 23, the sights are maintained in the lower, uncompressed position by springs, specifically, by spring elements 9 (for example, six coiled compression springs), which are seated in the corresponding holes in the upper side of the sights and slid onto the guiding lugs 29 of the locking plate 3 which are located in the cavity 26 of the holster above the sights and which push the sights into the inner space of the holster and onto the spacing surfaces located on the inner sides of the holster. The shaped sight guide 2 is provided with spacing surfaces on both longitudinal sides and is chamfered on the face sides to guide the firearm 23 or the silencer 25 in while the firearm 23 is being holstered or unholstered, with the lower surface reaching the inner cavity 26 of the holster. When a firearm 23 is holstered, with or without a silencer 25 attached, the upper surface of the slide of the firearm 23 or the body of the silencer 25 come into contact with the lower surface of the sight guide 2 and the sights are pressed away by the pressure of the spring elements 9 into the upper cavity above the sight guide 2. When a pistol is holstered, the pressure of the spring elements 9. i.e. springs, located above the sights is transferred across the lower surface of the sight guide 2 and on the upper surface of the slide of the firearm 23, thus keeping the firearm 23 holstered in the required position.

When the firearm 23 with a silencer 25 is being unholstered, the spring elements 9 push the sights slightly upwards and into the inner cavity 26 of the holster until the user fully unholsters the firearm 23. After the firearm 23 is unholstered, the pressure of from the spring elements 9 returns the sights in the uncompressed position.

The sight guide 2 comprises a shaped part equipped with a side guide that protrudes on the two longer sides of the part, with the shorter face side chamfered, and a longitudinal centre channel 27 to guide the sights of the firearm 23 in the lower part of the component. The upper surface of the component may contain various mounting holes or protrusions for mounting and locking spring elements 9, or its surface may be flat, depending on the shape of the spring elements 9 used. The spring elements 9 of the holster are various springs or spring components that ensure the movement of the sight guide 2 inside the shaped cavity 26 of the holster. The locking plate 3 of the holster is a flat part, or it may preferably be a part of a particular shape to accommodate the mounting and locking of the selected spring elements 9 to make the installation of the parts into the assembly easier. There is also the sight cover 4, which is a shaped part that secures the locking plate 3, the spring elements 9, and the sight guide 2 after the assembly parts are inserted in the inner cavity 26 of the holster.

The relevant spring elements 9 (springs) are inserted in the mounting holes in the upper surface of the sight guide 2 to ensure the movement of the system, which is set by applying the locking plate 3 with the appropriate guiding lugs 29. The assembly of the parts is compressed slightly and inserted into the longitudinal shaped cavity 26 in the upper section of the holster. The parts of the assembly are locked in the inner cavity 26 of the holster by sliding the sight cover 4 part into the inner cavity 26 and securing it in place with a threaded pin 17 that goes through the sight cover 4 body and into the two opposite walls of the holster.

The sight guide 2 comprises a plastic shaped part with an internal cavity 26 that extends past the side guide rail on the two longer sides of the part, and a centre channel 27 that guides the sight guide 2 when the firearm is being holstered in the lower section of the part. Both edges of the shorter face sides of the sight guide 2 are chamfered to ensure a smooth transition of a firearm 23 with a silencer 25 onto the sight guide 2 when the firearm 23 is being holstered or unholstered.

At rest, the spring elements 9 press the sight guide 2 into the outermost, working position, which is defined by the side lugs of the guide rails on the two opposite sides of the shaped cavity of the holster and the protrusions of the side guides of the sight guide 2. With the firearm 23 holstered, the lower surface of the sight guide 2 fits against the upper surface of the slide of the holstered firearm 23, and the pressure from the spring elements 9 acting on the sight guide 2 defines the position of the firearm 23 in the holster cavity.

With the firearm holstered and the silencer 25 and the tactical light 24 attached, the shape of the silencer 25 presses the sight guide 2 part over the latter's upper chamfered face edge into the shaped cavity 26, thus overcoming resistance from the spring elements 9 installed in the cavity between the sight guide 2 and the locking plate 3 to secure the sight guide 2 from movement and retain the part in the working position. When a firearm 23 is holstered all the way, the firearm 23 and the silencer 25 body travel the required distance to release the sight guide 2, and pressure from the spring elements 9 returns the sights back to the side guide limit in the default position.

After a firearm 23 with a silencer 25 is holstered, the sight guide 2 also works as a resistance safety element, retaining the firearm 23 in the holster by the edge of the silencer 25, and the holstered firearm 23 can be secured using another safety element—the hinged retention mechanism—by the upper edge of the slide and frame of the firearm 23.

A similar procedure applies to unholstering the firearm 23, as after all the retention systems and locking elements are unlocked, the edge of the silencer 25 on the firearm 23 being unholstered presses on the chamfered lower face surface of the sight guide 2, which overcomes resistance from the spring elements 9 and is pushed by the silencer 25 body into the shaped cavity 26 of the holster. After travelling the distance required for unholstering the firearm 23, the side guide 2 is pushed out again into the resting position on the side stopper of the holster.

When a firearm is holstered without a silencer 25 or a tactical light 24 attached, the sight guide 2 does not work as a resistance safety element. In this case, the lower surface of the sight guide 2 fits against the upper surface of the upper surface of the slide of the holstered firearm 23 and pressure by the spring elements 9 on the sight guide 2 defines the position of the firearm 23 in the holster. The firearm 23 is secured in the holster by a hinged segment by the upper edge of the slide and frame of the firearm 23 or by another suitable retention element.

The opposite side walls of the shaped body of the holster are provided with mounting holes for the attachment of the retention elements for securing the firearm 23 in the holster and with a notch segment that enables the mounting of additional safety elements and various types of belt-mounted holster carriers or other accessories (MOLLE and tactical slings, drop-leg platforms, etc.).

The basic embodiment of the holster is equipped with a drop-level belt attachment that consists of a plastic part with a sliding component to accommodate various belt widths, and a double safety for retaining a holstered firearm 23.

The basic embodiment of the holster is equipped with a main safety element, a hinged loop, that secures the firearm 23 in the holster by the upper edge of the slide and frame, with a control mechanism and a control button 8 placed on the side wall of the holster on the side corresponding to the user's shooting hand. Additional accessories can be added to the safety mechanism, namely, the control button 8 safety lever, to enhance the retention of the firearm 23 in the holster.

The main safety element comprises a hinged U-shaped with mounting holes in both ends of the lower section of the part, with metal spacers placed in the holes for assembly. On one lower end of the part, there is a metal side protrusion in which an inner torsion spring and a spacer for opening the segment are inserted, and a recess is provided to accommodate the latch of the control link. The control mechanism comprises a shaped part of a metal control link with an internal thread for mounting a button, a button segment, an inner compression spring, and a cap of the mechanism. The hinged segment and control mechanism is, as a complete assembly, screwed onto the top of the opposite walls of the holster, with the control mechanism button positioned on the side of the holster facing the user's body. The holster is controlled with the thumb of the shooting hand.

An additional safety element is represented by a safety lever that secures the button of the hinged mechanism against unintended and accidental disengagement. The safety lever is attached on the side facing the user's body at the notched segment of the ROTO 360° system, under the button of the control mechanism, and it is slid over a spacer installed under the belt attachment part, or onto the corresponding part of an accessory. Extending the safety mechanism by adding the accessory part of the side button safety lever enhances the retention of the firearm in the holster.

The assembly contains a set of plastic parts that enable all the parts of the assembly to be used for right/left-handed versions of the holster. All the basic mounting elements (holster body, mounting insert, safety elements, belt attachments, and accessory parts), full variability is ensured for use for various modifications of holster assemblies based on the application specifications. By modifying the holster body structurally, the holster can be modified to enable the use of a pistol with a silencer, a tactical light, and an OR segment attached.

Converting a Right-Handed Holster into a Left-Handed One:

The manufacturer supplies holsters in right-handed and left-handed versions based on the customer's request. During the life of the holster, the need may arise to convert the holster based on the user's needs.

Given the technical design of the holsters, the conversion procedure is simple and easy. After loosening the mounting connection screws, all the external parts are removed from the holster body (the hinged segment, the hinged mechanism assembly with the button, the belt attachment with the safety lever and the safety lever spacer). On the body of the holster, the locking screw with the tube cap attached is screwed into the opposite position. The (countersunk) M5×8 screw of the notch cover is loosened, the part is moved and attached to the notch segment on the opposite side. On the control link, the button segment is screw-mounted to the opposite side of the link, and the hinged segment is turned around and attached to the mounting protrusions in the upper section of the holster to obtain the basis for the conversion between the right- and the left-handed modifications. A torsion spring with the opposite orientation is inserted into the protrusion of the hinged segment, the spacers are inserted, and the hinged segment is attached to the holster body with the M5×8 mm screw. The assembly of the hinged mechanism is assembled in the opposite position and is fitted onto the protrusion of the hinged segment and the corresponding mounting holes on the opposite side, and the assembly is fixed by screws. Then the assembly of the safety lever with the spacer and belt attachment (or another accessory) is completed.

Using the Holster with a Pistol:

In order to holster and secure the firearm, the user proceeds as follows. Insert the pistol into the holster all the way to the inner stopper protrusion in the inner cavity of the holster under the trigger guard, or down to another selected stopper. If a silencer is mounted on the firearm, the silencer automatically opens the silencer tube cover when the pistol is inserted into the holster. The user secures the pistol in the holster with their shooting hand by swinging the hinged segment from the forward horizontal position over the slide of the firearm into the vertical position, wherein the pressure of the internal compression spring placed in the FE control link engages the latch of the FE link with the shaped recess in the hinged segment to lock it. In addition, the firearm may be secured with a dual safety that consists of a plastic part-a safety lever, which the user slides under the control button segment, thus preventing the latch of the FE control link from being released by accidental handling.

The user unholsters the firearm with the corresponding shooting hand in consideration of the selected safety elements. Before unholstering the firearm, the user first releases the safeties to the off-position. The uses the thumb of the shooting hand to move the safety lever all the way forward. This frees up the space under the button segment and places the holster at the first level of retention, with the pistol still being retained in the holster by the hinged segment.

If it is necessary to use the firearm, the user presses the control mechanism button. This releases the FE latch of the control link from the shaped side lug of the hinged segment, which is automatically swung forward by the force of the inner spring. All the safety mechanisms are now unlocked and the pistol with a silencer attached can be unholstered using appropriate drawing force to overcome the resistance of the sight guide. Where the holster is used to carry a firearm with a tactical light mounted and without a silencer, no resistance needs to be overcome to unholster the pistol. The user secures the pistol in the holster by following these steps in the reverse order.

Level of Retention:

In the basic embodiment, the holster is provided with double retention. The basic level of retaining the firearm in the holster is achieved by the hinged segment attached to the top of the holster, and by the control mechanism assembly with the control button located on the side of the holster facing the user's body, wherein the system secures the firearm over the upper surface of the slide with the hinged segment that is set and secured with the latch of the FE control link in the vertical position.

In addition, the pistol can also be retained with an additional safety-a safety lever slid by the user under the control button segment that prevents the unintentional release of the latch of the FE control link by accidental handling to increase the level of retention.

The optional level of retention depends on the mutual combination of the retention features and the additional components of the assembly that are used to the given extent in all modifications.

INDUSTRIAL APPLICABILITY

The holster according to the present invention is intended for pistols with a movable placement of the sights in the inner cavity of the holster, and it enables securing the firearm with a tactical light and a silencer attached, or with a tactical light and without a silencer attached, or with a silencer and without a tactical light attached, or the firearm without such accessories.

LIST OF REFERENCE SYMBOLS

1 . . . holster body
2 . . . sight guide
3 . . . sight locking plate
4 . . . sight cover
5 . . . retention loop
6 . . . retention loop cover
7 . . . retention loop link
8 . . . loop control button
9 . . . sight spring elements
10 . . . silencer cover nuts
11 . . . button screw
12 . . . loop screw
13 . . . silencer cover screw
14 . . . loop cover screw
15 . . . silencer cover
16 . . . notch cover
17 . . . sight cover locking pin
18 . . . link spring
19 . . . retention loop spring
20 . . . spacer column
21 . . . spacer column
22 . . . notch cover screw
23 . . . pistol frame
24 . . . light
25 . . . silencer
26 . . . inner cavity of the holster
27 . . . guide body centre channel
29 . . . locking plate guiding lugs

The invention claimed is:

1. A pistol holster which is formed by a rigid hollow body which fully covers an firearm except for a grip and thus protects the firearm from damage, wherein the pistol holster contains a longitudinal inner cavity situated inside and under a back of the pistol holster, in which longitudinal inner cavity there is a movably and flexibly seated firearm sight guide, engaged in holes in the rigid hollow body of which firearm sight guide are spring elements mounted and locked therein, which also fit against a flat locking plate in the longitudinal inner cavity of the pistol holster, with the pistol holster also containing a sight cover to secure a position of the firearm sight guide with the flat locking plate and spring elements in the longitudinal inner cavity.

2. The pistol holster according to claim 1, wherein a body of the firearm sight guide is provided with a centre channel along its entire length to guide sights, with two shorter face sides of the body of the firearm sight guide being chamfered to guide the firearm more easily when holstering or unholstering the firearm.

3. The pistol holster according to claim 1, wherein the spring elements comprise at least one of coiled compression springs and profiled flat springs, that are seated in holes in an upper section of a sight guide body and slid over guide lugs of the flat locking plate that is located in the longitudinal innter cavity of the pistol holster above the body of the firearm sight guide.

4. The pistol holster according to claim 1, wherein the rigid hollow body of the holster is equipped with side lugs for mounting of a belt attachment for the firearm.

5. The pistol holster according to claim 1, wherein a lower side section of the pistol holster is equipped with an inner spacer to accommodate a tactical light.

6. The pistol holster according to claim 2, wherein the spring elements comprise at least one of coiled compression springs and profiled flat springs, that are seated in holes in an upper section of a sight guide body and slid over guide lugs of the flat locking plate that is located in the longitudinal innter cavity of the pistol holster above the body of the firearm sight guide.

7. The pistol holster according to claim 2, wherein the rigid hollow body of the holster is equipped with side lugs for mounting of a belt attachment for the firearm.

8. The pistol holster according to claim 3, wherein the rigid hollow body of the holster is equipped with side lugs for mounting of a belt attachment for the firearm.

9. The pistol holster according to claim 2, wherein a lower side section of the pistol holster is equipped with an inner spacer to accommodate a tactical light.

10. The pistol holster according to claim 3, wherein a lower side section of the pistol holster is equipped with an inner spacer to accommodate a tactical light.

11. The pistol holster according to claim 4, wherein a lower side section of the pistol holster is equipped with an inner spacer to accommodate a tactical light.

* * * * *